US006814139B2

(12) United States Patent
Hejl et al.

(10) Patent No.: US 6,814,139 B2
(45) Date of Patent: Nov. 9, 2004

(54) GRAVEL PACKING APPARATUS HAVING AN INTEGRATED JOINT CONNECTION AND METHOD FOR USE OF SAME

(75) Inventors: David A. Hejl, Dallas, TX (US); Robert W. Crow, Irving, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 99 days.

(21) Appl. No.: 10/272,875

(22) Filed: Oct. 17, 2002

(65) Prior Publication Data

US 2004/0074641 A1 Apr. 22, 2004

(51) Int. Cl.[7] ..... E21B 43/04; E21B 43/08

(52) U.S. Cl. ..... 166/51; 166/278; 166/235; 166/236

(58) Field of Search ..... 166/278, 51, 236, 166/233, 227, 231, 235

(56) References Cited

U.S. PATENT DOCUMENTS

| | | | | |
|---|---|---|---|---|
| 1,975,162 A | | 10/1934 | Layne | |
| 2,342,913 A | | 2/1944 | Williams et al. | |
| 2,344,909 A | | 3/1944 | Williams et al. | |
| 2,788,073 A | * | 4/1957 | Brown | 166/88.4 |
| 4,102,395 A | | 7/1978 | Robinson | |

(List continued on next page.)

FOREIGN PATENT DOCUMENTS

| | | |
|---|---|---|
| EP | 1 132 571 A1 | 2/2001 |
| WO | WO 99/12630 | 3/1999 |
| WO | WO 00/61913 | 10/2000 |
| WO | WO 01/14691 A1 | 3/2001 |
| WO | WO 01/42620 A1 | 6/2001 |
| WO | WO 01/44619 A1 | 6/2001 |
| WO | WO 01/49970 A1 | 7/2001 |
| WO | WO 02/10554 A1 | 2/2002 |

OTHER PUBLICATIONS

Restarick of Otis Engineering Copr.; "Mechanical FluidLoss Control Systems Used During Sand Control Operations"; 1992; pp. 21–36.

Halliburton Energy Services, Inc.; "Sand Control Screens"; 1994; 4 pages.

(List continued on next page.)

*Primary Examiner*—David Bagnell
*Assistant Examiner*—G M Collins
(74) *Attorney, Agent, or Firm*—Lawrence R. Youst

(57) ABSTRACT

A gravel packing apparatus comprises multiple joints each having substantially the same construction and each having a perforated outer tubular (150, 152) positioned around a sand control screen (154, 156) including a slurry passageway (190, 194) and a production pathway (188, 192) therebetween. First and second transition members (210, 204) are disposed at opposite ends of each joint. When two such joints are connected together, the second transition member (204) of one joint is proximate the first transition member (210) of the next joint such that a fluid traveling from the slurry passageway (190) of one joint to the slurry passageway (194) of the next joint travels from the exterior to the interior of the second transition member (204) of the one joint and from the interior to the exterior of the first transition member (210) of the next joint.

37 Claims, 14 Drawing Sheets

U.S. PATENT DOCUMENTS 4,428,428 A 1/1984 Smyrl et al.
4,558,742 A 12/1985 Huang et al.
4,627,488 A 12/1986 Szarka
4,932,474 A 6/1990 Schroeder, Jr. et al.
4,945,991 A 8/1990 Jones
5,082,052 A 1/1992 Jones et al.
5,113,935 A 5/1992 Jones et al.
5,161,613 A 11/1992 Jones
5,161,618 A 11/1992 Jones et al.
5,165,476 A 11/1992 Jones
5,333,688 A 8/1994 Jones et al.
5,343,949 A 9/1994 Ross et al.
5,355,956 A 10/1994 Restarick
5,390,966 A 2/1995 Cox et al.
5,419,394 A 5/1995 Jones
5,443,117 A 8/1995 Ross
5,476,143 A 12/1995 Sparlin et al.
5,515,915 A * 5/1996 Jones et al. ..... 166/51
5,588,487 A 12/1996 Bryant
5,636,691 A 6/1997 Hendrickson et al.
5,755,286 A 5/1998 Ebinger
5,842,516 A 12/1998 Jones
5,848,645 A 12/1998 Jones
5,865,251 A 2/1999 Rebardi et al.
5,868,200 A 2/1999 Bryant et al.
5,890,533 A 4/1999 Jones
5,921,318 A 7/1999 Ross
5,934,376 A 8/1999 Nguyen et al.
5,988,285 A 11/1999 Tucker et al.
6,003,600 A 12/1999 Nguyen et al.
6,047,773 A 4/2000 Zeltmann et al.
6,059,032 A 5/2000 Jones
6,116,343 A 9/2000 Van Petegem et al.
6,125,933 A 10/2000 Ross
6,220,345 B1 4/2001 Jones et al.
6,227,303 B1 5/2001 Jones
6,230,803 B1 5/2001 Morton et al.
6,302,208 B1 10/2001 Walker et al.
6,343,651 B1 2/2002 Bixenman
6,450,263 B1 9/2002 Schwendemann
6,464,007 B1 10/2002 Jones
6,516,881 B2 2/2003 Hailey, Jr.
6,516,882 B2 2/2003 McGregor et al.
6,557,634 B2 5/2003 Hailey, Jr. et al.
6,581,689 B2 6/2003 Hailey, Jr.
6,588,506 B2 7/2003 Jones
6,588,507 B2 7/2003 Dusterhoft et al.
6,698,518 B2 * 3/2004 Royer et al. ..... 166/278
2002/0157837 A1 10/2002 Bode et al.

OTHER PUBLICATIONS

Ebinger of Ely & Associates Inc.; "Frac Pack Technology Still Evolving"; 1995; pp. 60–70; Oil & Gas Journal.

Hailey and Cox of Haliburton Energy Services, Inc. and Johnson of BP Exploration (Alaska); "Screenless Single Trip Multizone Sand Control Tool System Saves Rig Time"; Feb. 2000; pp. 1–11; Society of Petroleum Engineers Inc.

Halliburton Energy Services, Inc.; "Caps Sand Control Service for Horizontal Completions Improves Gravel Pack Reliability and Increases Production Potential from Horizontal Completions"; Aug. 2000; 2 pages.

Halliburton Energy Services, Inc.; "CAPS Concertric Annular Packaging Service for Sand Control"; Aug. 2000; 4 pages.

Saldungaray of Schlumberger, TRONCOSO and SANTOSO of Repsol–YPF; "Simultaneous Gravel Packing and Filter Cake Removal in Horizontal Wells Applying Shunt Tubes and Novel Carrier and Breaker Fluid"; Mar. 2001: pp. 1–6; Society of Petroleum Engineers, Inc.

Schlumberger, "QUANTUM Zonal Isolation Tool"; pp. 12–13; Sand Face Completions Catalog.

Halliburton Energy Services, Inc.; "Absolute Isolation System (AIS) Components"; 1 page.

OSCA Corporate Headquarters; "HPR–ISO System"; 2000; 1 page; Technical Bulletin.

OSCA Corporate Headquarters; "The ISO System"; 2000; 1 page; Technical Bulletin.

* cited by examiner

GRAVEL PACKING APPARATUS HAVING AN INTEGRATED JOINT CONNECTION AND METHOD FOR USE OF SAME

TECHNICAL FIELD OF THE INVENTION

This invention relates in general to preventing the production of particulate materials through a wellbore traversing an unconsolidated or loosely consolidated subterranean formation and, in particular, to a gravel packing apparatus having an integrated joint connection and a method for use of the same.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as the tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge. It has been found, however, that shunt tubes installed on the exterior of sand control screens are susceptible to damage during installation and may fail during a gravel pack operation. In addition, it has been found that it is difficult and time consuming to make all of the necessary fluid connections between the numerous joints of shunt tubes required for typical production intervals. Moreover, it has been found that the velocity of the fluid slurry may decrease below the settling velocity of the fluid slurry in transition sections that allow mixing of the flow streams from multiple shunt tubes such that the gravel drops out of the fluid slurry and clogs the transition section preventing further flow therethrough.

Therefore a need has arisen for an apparatus and method for gravel packing a production interval traversed by a wellbore that overcomes the problems created by sand bridges. A need has also arisen for such an apparatus that is not susceptible to damage during installation. Further, a need has arisen for such an apparatus that is not difficult or time consuming to assemble. Moreover, a need has arisen for such an apparatus that maintains sufficient velocity of the fluid slurry in transition sections.

SUMMARY OF THE INVENTION

The present invention disclosed herein comprises a gravel packing apparatus and method for gravel packing a production interval of a wellbore that traverses an unconsolidated or loosely consolidated formation that overcomes the problems created by the development of a sand bridge between a sand control screen and the wellbore. Importantly, the gravel packing apparatus of the present invention is not susceptible to damage during installation or failure during use and is not difficult or time consuming to assemble.

The gravel packing apparatus of the present invention comprises an outer tubular forming a first annulus with the wellbore and a sand control screen disposed within the outer tubular forming a second annulus therebetween. The outer tubular includes a plurality of openings that allow for the production of fluids therethrough and plurality of outlets that allow the distribution of a fluid slurry containing gravel therethrough.

In the volume within the second annulus between the sand control screen and the outer tubular there are one or more channels that define axially extending slurry passageways with sheet members positioned between the channels and the sand control screen. The sheet members create a barrier to the flow of fluids between the channels and the sand control screen. The volume within the second annulus between adjacent channels forms axially extending production pathways. The channels prevent fluid communication between the production pathways and the slurry passageways. In addition, transition members at either end of each joint of the gravel packing apparatus of the present invention define the axial boundaries of the production pathways.

As such, when a fluid slurry containing gravel is injected through the slurry passageways, the fluid slurry exits the slurry passageways through outlets in the channels and the outer tubular leaving a first portion of the gravel in the first annulus. Thereafter, the fluid slurry enters the openings in the outer tubular leaving a second portion of the gravel in the production pathways. Thus, when formation fluids are produced, the formation fluids travel radially through the production pathways by entering the openings in the outer tubular and exiting the production pathways through the sand control screen. The formation fluids pass through the first portion of the gravel in the first annulus prior to entry into the production pathways, which contains the second portion of the gravel, both of which filter out the particulate materials in the formation fluids. Formation fluids are prevented, however, from traveling radially through the slurry passageways as the sheet members prevent such flow.

In a typical gravel packing operation using the gravel packing apparatus of the present invention, the first annulus between the outer tubular and the wellbore may serve as a primary path for delivery of a fluid slurry. This region serves as the primary path as it provides the path of least resistance to the flow of the fluid slurry. When the primary path becomes blocked by sand bridge formation, the production pathways of the present invention serves as a secondary path for delivery of the fluid slurry. The production pathways serve as the secondary path as they provide the path of second least resistance to the flow of the fluid slurry. When the primary and secondary paths become blocked by sand bridge formation, the slurry passageways serve as a tertiary path for delivery of the fluid slurry. The slurry passageways serve as the tertiary path as they provide the path of greatest resistance to the flow of the fluid slurry but are least likely to have sand bridge formation therein due to the high velocity of the fluid slurry flowing therethrough and their substantial isolation from the formation.

Commonly, more than one joint of the gravel packing apparatus must be coupled together to achieve a length sufficient to gravel pack an entire production interval. In such cases, multiple joints of the gravel packing apparatus of the present invention are coupled together via a single threaded connection between two outer tubulars of adjacent joints such that an integrated joint connection is formed wherein the slurry passageways of the various joints are in fluid communication with one another allowing an injected fluid slurry to flow from one such joint to the next.

More specifically, the integrated joint connection includes a lower end transition member of an upper joint positioned proximate an upper end transition member of a lower joint. In this configuration, when the fluid slurry is traveling from the slurry passageway of the upper joint to the slurry passageway of the lower joint, the fluid slurry travels from the exterior to the interior of the lower end transition member of the upper joint then from the interior to the exterior of the upper end transition member of the lower joint.

In another aspect, the present invention involves a method for gravel packing an interval of a wellbore that includes providing a gravel packing apparatus having a plurality of joints each including an outer tubular positioned around a sand control screen assembly forming a screen annulus therebetween including an axially extending slurry passageway and first and second transition members disposed at opposite ends of each joint, connecting first and second joints such that the second transition member of the first joint is proximate the first transition member of the second joint, locating a gravel packing apparatus within the interval of the wellbore forming a wellbore annulus, injecting a fluid slurry into the slurry passageway of the first joint such that a first portion of the fluid slurry exits the slurry passageway into the wellbore annulus and such that a second portion of the fluid slurry travels from the slurry passageway of the first joint to the slurry passageway of the second joint by traveling from the exterior to the interior of the second transition member of the first joint then from the interior to the exterior of the first transition member of the second joint and terminating the injecting when the wellbore annulus is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
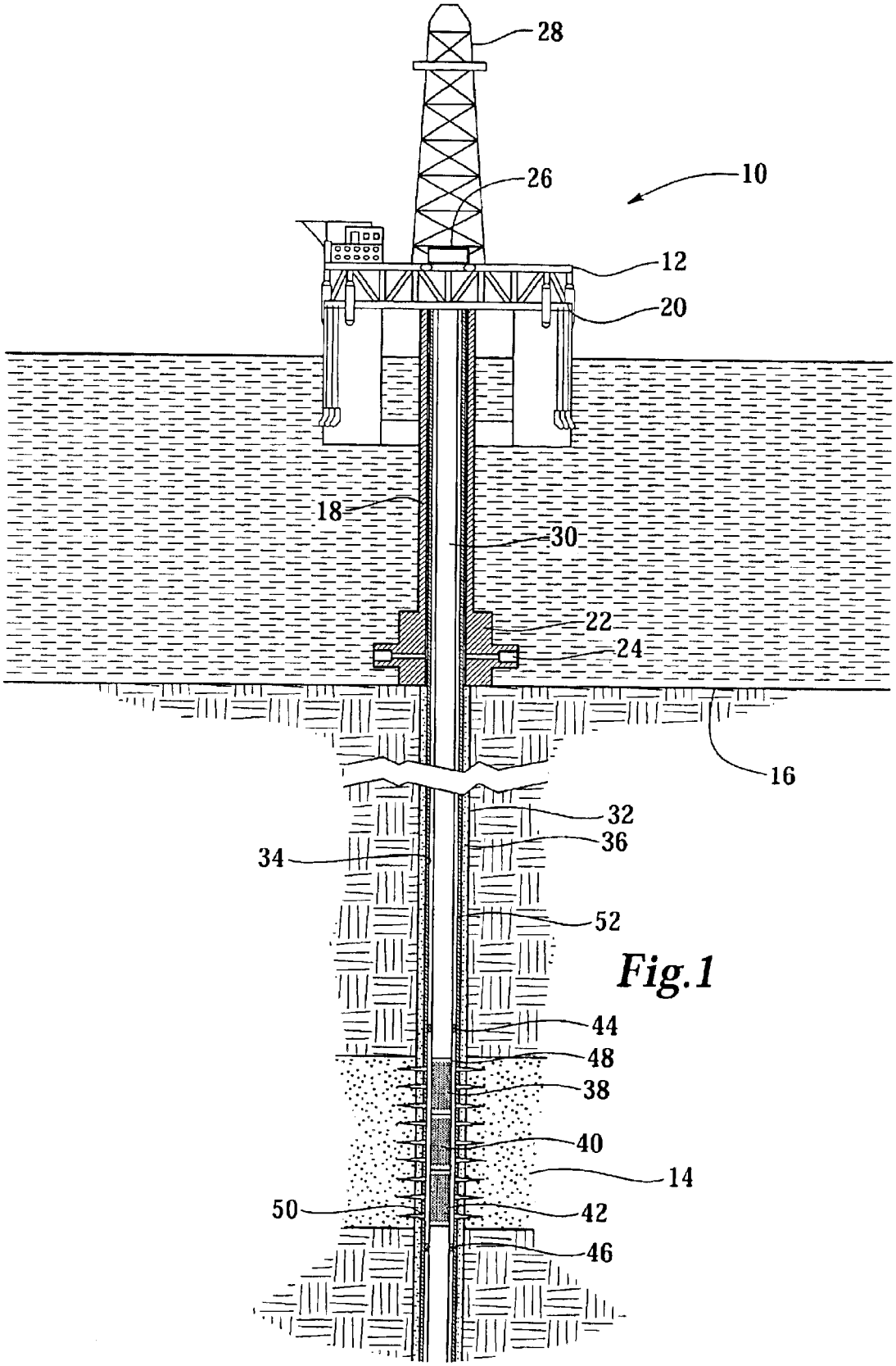
FIG. 1 is a schematic illustration of an offshore oil and gas platform operating a gravel packing apparatus of the present invention.

Referring initially to FIG. 1, a gravel packing apparatus positioned in an interval of a wellbore and operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including joints 38, 40, 42 or the gravel packing apparatus of the present invention positioned in an interval of wellbore 32 adjacent to formation 14 between packers 44, 46. When it is desired to gravel pack annular region 48, work string 30 is lowered through casing 34 until joints 38, 40, 42 are positioned adjacent to formation 14 including perforations 50. Thereafter, a fluid slurry including a liquid carrier and a particulate material such as sand, gravel or proppants is pumped down work string 30.

As explained in more detail below, the fluid slurry may be injected entirely into joint 38 and sequentially flow through joints 40, 42. During this process, portions of the fluid slurry exit each joint 38, 40, 42 such that the fluid slurry enters annular region 48. Once in annular region 48, a portion of the gravel in the fluid slurry is deposited therein. Some of the liquid carrier may enter formation 14 through perforation 50 while the remainder of the fluid carrier, along with some of the gravel, reenters certain sections of joints 38, 40, 42 depositing gravel in those sections. As a sand control screen (not pictured) is positioned within joints 38, 40, 42, the gravel remaining in the fluid slurry is disallowed from further migration. The liquid carrier, however, can travel through the sand control screen, into work string 30 and up to the surface in a known manner, such as through a wash pipe and into the annulus 52 above packer 44. The fluid slurry is pumped down work string 30 through joints 38, 40, 42 until annular section 48 surrounding joints 38, 40, 42 and portions of joints 38, 40, 42 are filled with gravel.

Alternatively, instead of injecting the entire stream of fluid slurry into joints 38, 40, 42, all or a portion of the fluid slurry could be injected directly into annular region 48 in a known manner such as through a crossover tool (not pictured) which allows the slurry to travel from the interior of work string 30 to the exterior of work string 30. Again, once the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of joints 38, 40, 42 filling those sections with gravel. The sand control screen (not pictured) within joints 38, 40, 42 disallows further migration of the gravel but allows the liquid carrier to travel therethrough into work string 30 and up to the surface. If the fluid slurry is injected directly into annular region 48 and a sand bridge forms in annular region 48, the fluid slurry is diverted into joints 38, 40, 42 to bypass this sand bridge such that a complete pack can nonetheless be achieved. The fluid slurry entering joints 38, 40, 42 may enter joints 38, 40, 42 proximate work string 30 or may enter joints 38, 40, 42 from annular region 48 via one or more inlets on the exterior of one or more of the joints 38, 40, 42. These inlets may include pressure actuated devices, such as valves, rupture disks and the like disposed therein to regulate the flow of the fluid slurry therethrough.

Even though FIG. 1 depicts a vertical well, it should be noted by one skilled in the art that the gravel packing apparatus of the present invention is equally well-suited for use in wells having other geometries including deviated wells, inclined wells or horizontal wells. Also, even though FIG. 1 depicts an offshore operation, it should be noted by one skilled in the art that the gravel packing apparatus of the present invention is equally well-suited for use in onshore operations.

Figure 2:
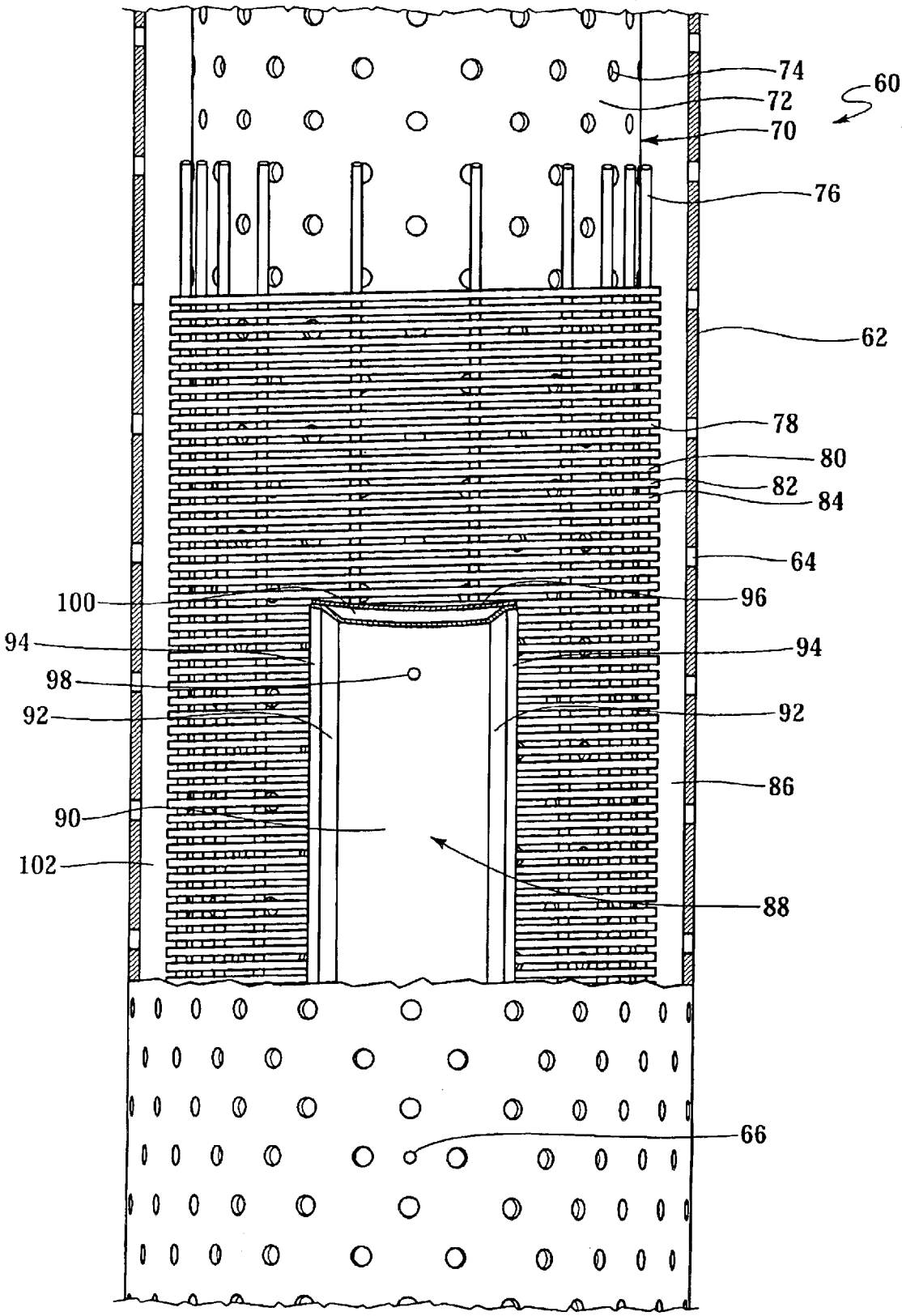
FIG. 2 is partial cut away view of a gravel packing apparatus of the present invention.

Referring now to FIG. 2, therein is depicted a partial cut away view of a gravel packing apparatus of the present invention that is generally designated 60. Apparatus 60 has an outer tubular 62 that includes a plurality of openings 64 that are substantially evenly distributed around and along the length of outer tubular 62. In addition, outer tubular 62 includes a plurality of outlets 66. For reasons that will become apparent to those skilled in the art, the density of opening 64 of outer tubular 62 is much greater than the density of outlets 66 of outer tubular 62. Also, it should be noted by those skilled in the art that even though FIG. 2 has depicted openings 64 and outlets 66 as being circular, other shaped openings may alternatively be used without departing from the principles of the present invention. Likewise, even though FIG. 2 has depicted openings 64 as being larger than outlets 66, openings 64 could alternatively be smaller than or the same size as outlets 66 without departing from the principles of the present invention. In addition, the exact number, size and shape of openings 64 are not critical to the present invention, so long as sufficient area is provided for fluid production therethrough and the integrity of outer tubular 62 is maintained.

Disposed within outer tubular 62 is a sand control screen 70. Sand control screen 70 includes a base pipe 72 that has a plurality of openings 74 which allow the flow of production fluids into the production tubing. The exact number, size and shape of openings 74 are not critical to the present invention, so long as sufficient area is provided for fluid production and the integrity of base pipe 72 is maintained to prevent the collapse of sand control screen 70 during production.

Spaced around base pipe 72 is a plurality of ribs 76. Ribs 76 are generally symmetrically distributed about the axis of base pipe 72. Ribs 76 are depicted as having a cylindrical cross section, however, it should be understood by one skilled in the art that ribs 76 may alternatively have a rectangular or triangular cross section or other suitable geometry. Additionally, it should be understood by one skilled in the art that the exact number of ribs 76 will be dependent upon the diameter of base pipe 72 as well as other design characteristics that are well known in the art.

Wrapped around ribs 76 is a screen wire 78. Screen wire 78 forms a plurality of turns, such as turn 80, turn 82 and turn 84. Between each of the turns is a gap through which formation fluids flow. The number of turns and the gap between the turns are determined based upon the characteristics of the formation from which fluid is being produced and the size of the gravel to be used during the gravel packing operation. Together, ribs 76 and screen wire 78 may form a sand control screen jacket which is attached to base pipe 72 by welding or other suitable techniques.

Disposed within an annulus 86 on opposite sides of one another and between outer tubular 62 and sand control screen 70 is a pair of channels 88, only one being visible. Channels 88 include a web 90 and a pair of oppositely disposed sides 92 each having an end 94. Ends 94 are attached to a sheet member 96 and, in turn, to sand control screen 70 by, for example, welding or other suitable techniques. Channels 88 includes a plurality of outlets 98 that are substantially aligned with outlets 66 of outer tubular 62. Together, channels 88 and sheet members 96 define slurry passageways 100. Between channels 88 are production pathways 102 which are defined by the radial boundaries of outer tubular 62 and sand control screen 70 and the circumferential boundaries of sides 92 of the oppositely disposed channels 88. Slurry passageways 100 and production pathways 102 are in substantial fluid isolation from one another.

It should be understood by those skilled in the art that while FIG. 2 has depicted a wire wrapped sand control screen, other types of filter media could alternatively be used in conjunction with the apparatus of the present invention, including, but not limited to, a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough.

Figure 3:
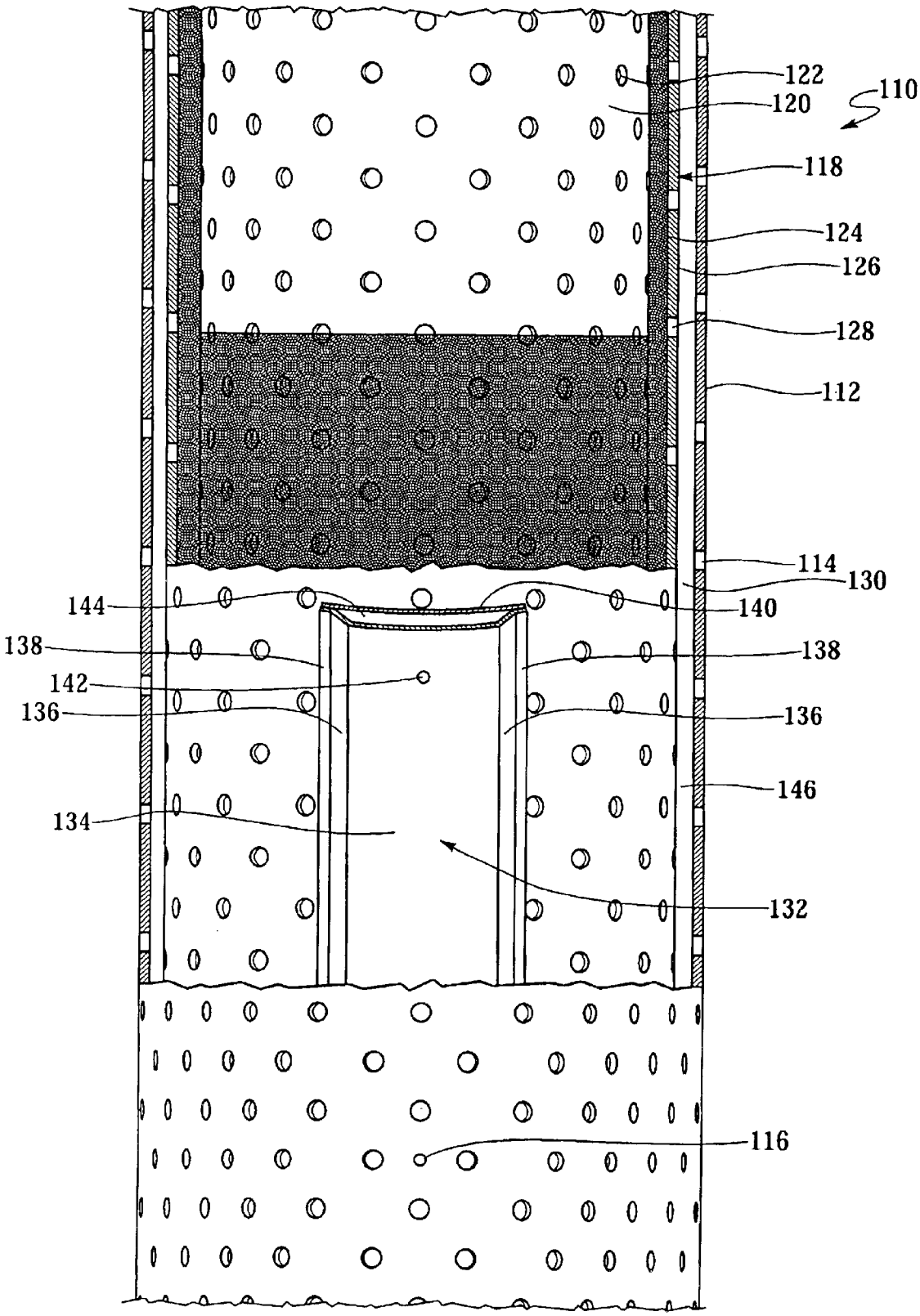
FIG. 3 is partial cut away view of a gravel packing apparatus of the present invention.
Figure 4:
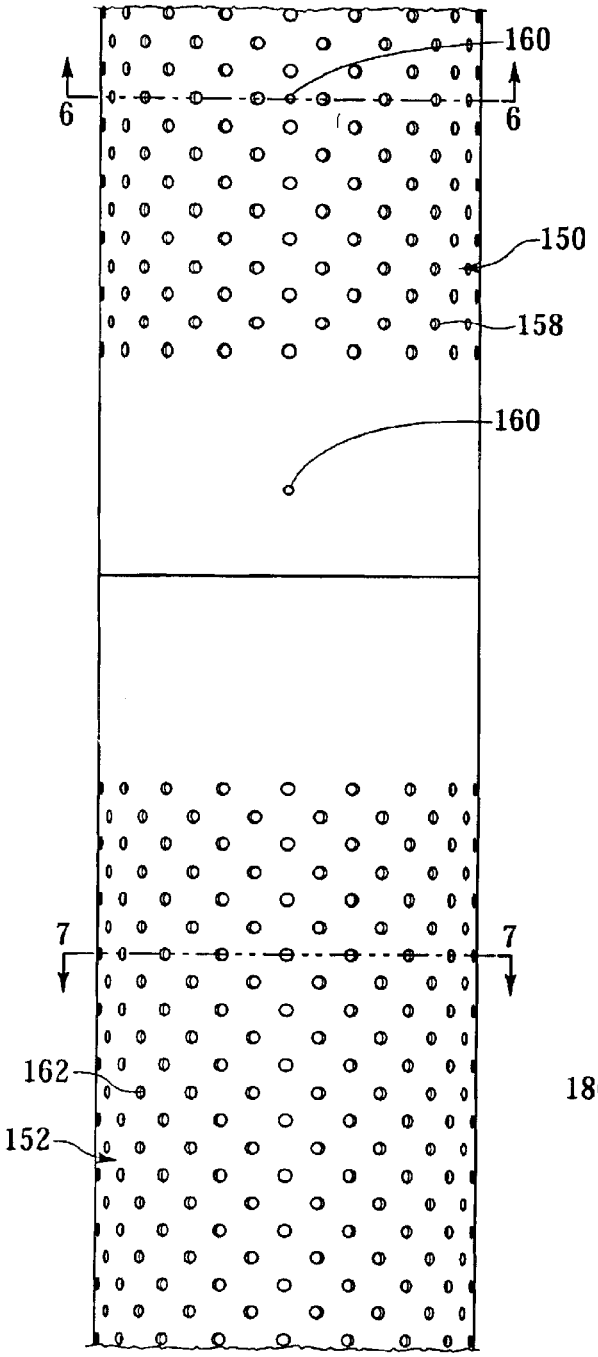
FIG. 4 is a side view of portions of two adjacent outer shrouds of a gravel packing apparatus of the present invention that are coupled together.
Figure 5:
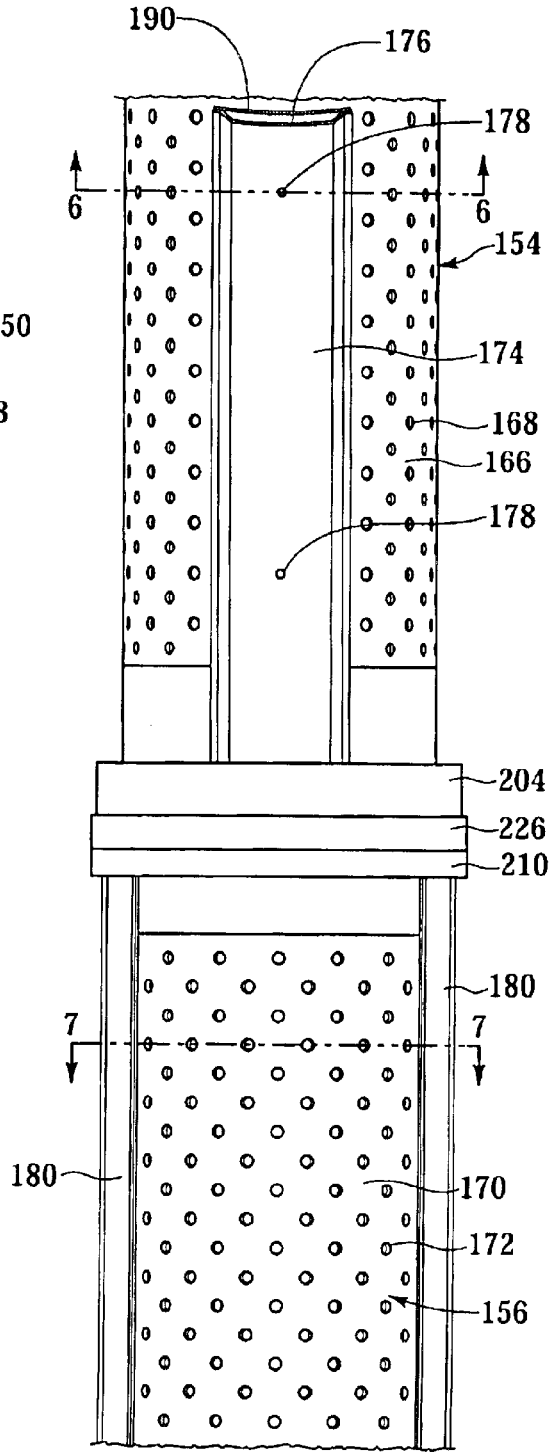
FIG. 5 is a side view of portions of two adjacent sand control screen assemblies of a gravel packing apparatus of the present invention.

More specifically and referring now to FIG. 3, therein is depicted a partial cut away view of a gravel packing apparatus of the present invention that is generally designated 110. Apparatus 110 has an outer tubular 112 that includes a plurality of openings 114 that are substantially evenly distributed around and along the length of outer tubular 112, which allow the flow of production fluids therethrough. In addition, outer tubular 112 includes a plurality of outlets 116.

Disposed within outer tubular 112 is a sand control screen assembly 118. Sand control screen assembly 118 includes a base pipe 120 that has a plurality of openings 122 which allow the flow of production fluids into the production tubing. The exact number, size and shape of openings 122 are not critical to the present invention, so long as sufficient area is provided for fluid production and the integrity of base pipe 120 is maintained.

Positioned around base pipe 120 is a fluid-porous, particulate restricting wire mesh screen 124. Screen 124 is designed to allow fluid flow therethrough but prevent the flow of particulate materials of a predetermined size from passing therethrough. The layers of wire mesh may include drain layers that have a mesh size that is larger than the mesh size of the filter layers. For example, a drain layer may preferably be positioned as the outermost layer and the innermost layer of wire mesh screen 124 with the filter layer or layers positioned therebetween. Positioned around screen 124 is a screen wrapper 126 that has a plurality of openings 128 which allow the flow of production fluids therethrough. The exact number, size and shape of openings 128 is not critical to the present invention, so long as sufficient area is provided for fluid production and the integrity of screen wrapper 126 is maintained. Typically, various sections of screen 124 and screen wrapper 126 are manufactured together as a unit by, for example, diffusion bonding or sintering a number layers of wire mesh that form screen 124 together with screen wrapper 126, then rolling the unit into a tubular configuration. The two ends of the tubular unit are then seam welded together. Several tubular units of the screen and screen wrapper combination are placed over each joint of base pipe 120 and secured thereto by welding or other suitable technique.

Disposed in annulus 130 between outer tubular 112 and sand control screen 118 and on opposite sides of each other is a pair of channels 132, only one channel 132 being visible. Channels 132 include a web 134 and a pair of oppositely disposed sides 136 each having an end 138. Ends 138 are attached to a sheet member 140 and, in turn, to screen wrapper 126 by welding or other suitable technique. Channels 132 include a plurality of outlets 142 that are substantially aligned with outlets 116 of outer tubular 112 and are preferably formed at the same time by drilling or other suitable technique once gravel packing apparatus 110 is assembled. Together, channels 132 and sheet members 140 form slurry passageways 144.

It should be noted that in some embodiments, channels 132 could be attached directly to screen wrapper 126 if the adjacent portions of screen wrapper 126 are not perforated such that slurry passageways 144 may be formed. In either case, once screen 124 is assembled with channels 132 attached thereto, screen 124 is positioned within outer tubular 112, as explained in greater detail below. Once in this configuration, channels 132 are pressurized such that channels 132 expand into contact with the interior of outer tubular 112. Thereafter, outlets 142 of channels 132 and outlets 116 of outer tubular 112 may be drilled. Also, channels 132 define the circumferential boundary between slurry passageways 144 and production pathways 146.

Referring now to FIGS. 4–7, therein are depicted portions of two joints of outer tubulars designated 150 and 152 and corresponding portions of two joints of sand control screens designated 154 and 156, respectively. Outer tubular 150 has a plurality of openings 158 and several outlets 160. Likewise, outer tubular 152 has a plurality of openings 162 and several outlets 164, which are not visible in FIG. 4.

Figure 6:
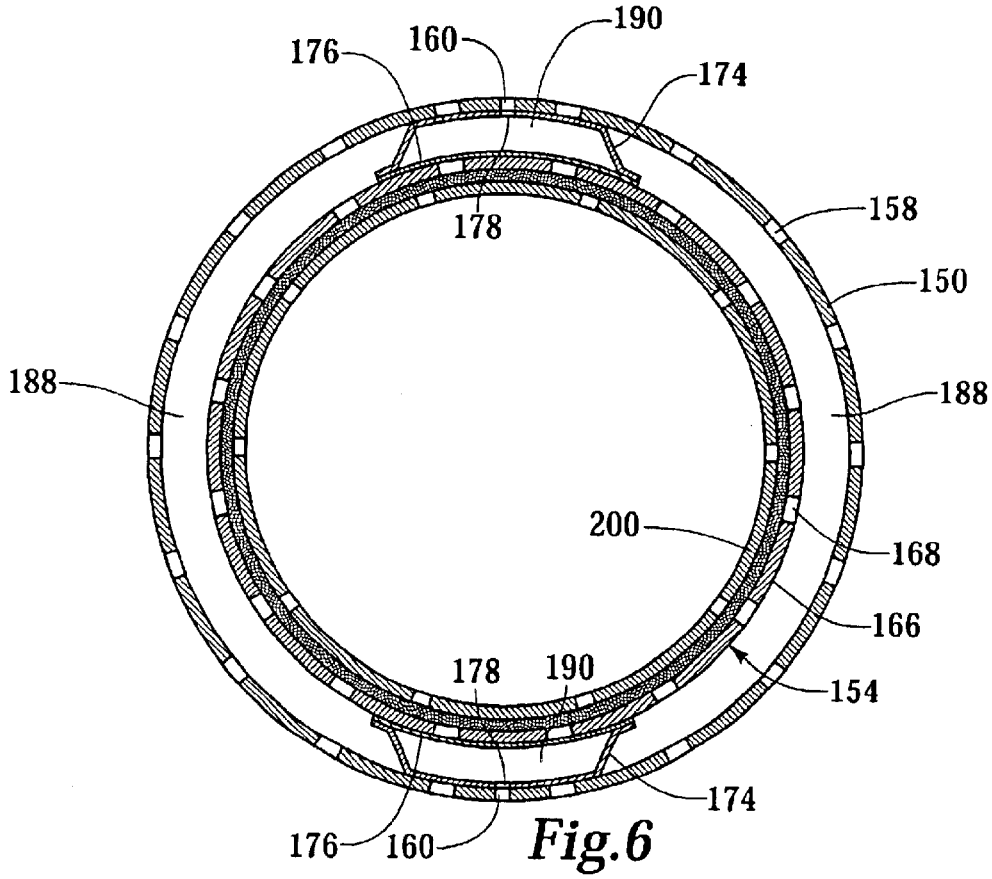
FIG. 6 is a cross sectional view of a gravel packing apparatus of the present invention taken along line 6—6 of FIGS. 4 and 5.
Figure 7:
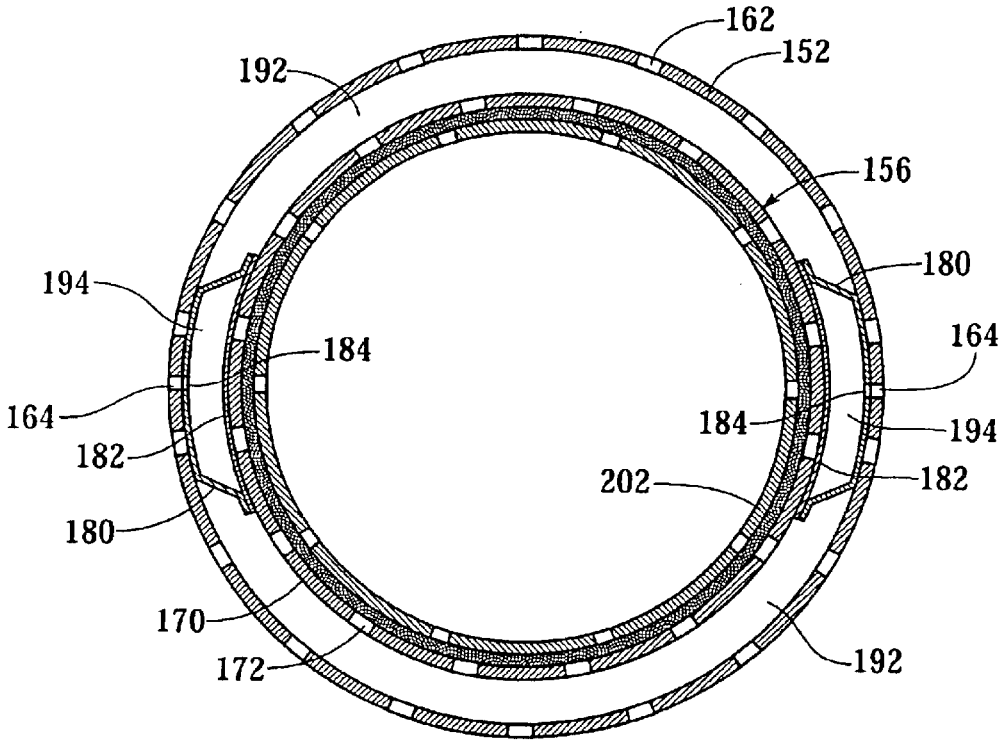
FIG. 7 is a cross sectional view of a gravel packing apparatus of the present invention taken along line 7—7 of FIGS. 4 and 5.

Sand control screen 154 includes outer wrapper 166 that has a plurality of openings 168. Likewise, sand control screen 156 includes outer wrapper 170 that has a plurality of openings 172. Sand control screen 154 has a pair of channels 174 and a pair of sheet members 176 attached thereto, only one of each being visible in FIG. 5. Channels 174 include outlets 178. Likewise, sand control screen 156 has a pair of channels 180 and a pair of sheet members 182 attached thereto. Channels 180 includes a plurality of outlets 184 which are not visible in FIG. 5. In the illustrated embodiment, sand control screens 154, 156 would be positioned within outer tubulars 150, 152 such that outlets 178 are axially and circumferentially aligned with outlets 160 of outer tubular 150, as best seen in FIG. 6 and such that outlets 184 are axially and circumferentially aligned with outlets 164 of outer tubular 152, as best seen in FIG. 7.

Channels 174 define the circumferential boundaries of production pathways 188 and, together with sheet members 176, channels 174 define slurry passageways 190. Channels 180 define the circumferential boundaries of production pathways 192 and, together with sheet members 182, channels 180 define slurry passageways 194.

As should become apparent to those skilled in the art, even though FIGS. 4–7 depict adjoining joints of the gravel packing apparatus of the present invention at a ninety-degree circumferential phase shift relative to one another, any degree of circumferential phase shift is acceptable using the present invention as the relative circumferential position of adjoining joints of the gravel packing apparatus of the present invention does not affect the operation of the present invention. As such, the mating of adjoining joints of the apparatus for gravel packing an interval of a wellbore of the present invention is substantially similar to mating typical joints of pipe to form a pipe string requiring no special coupling tools or techniques.

Figure 8:
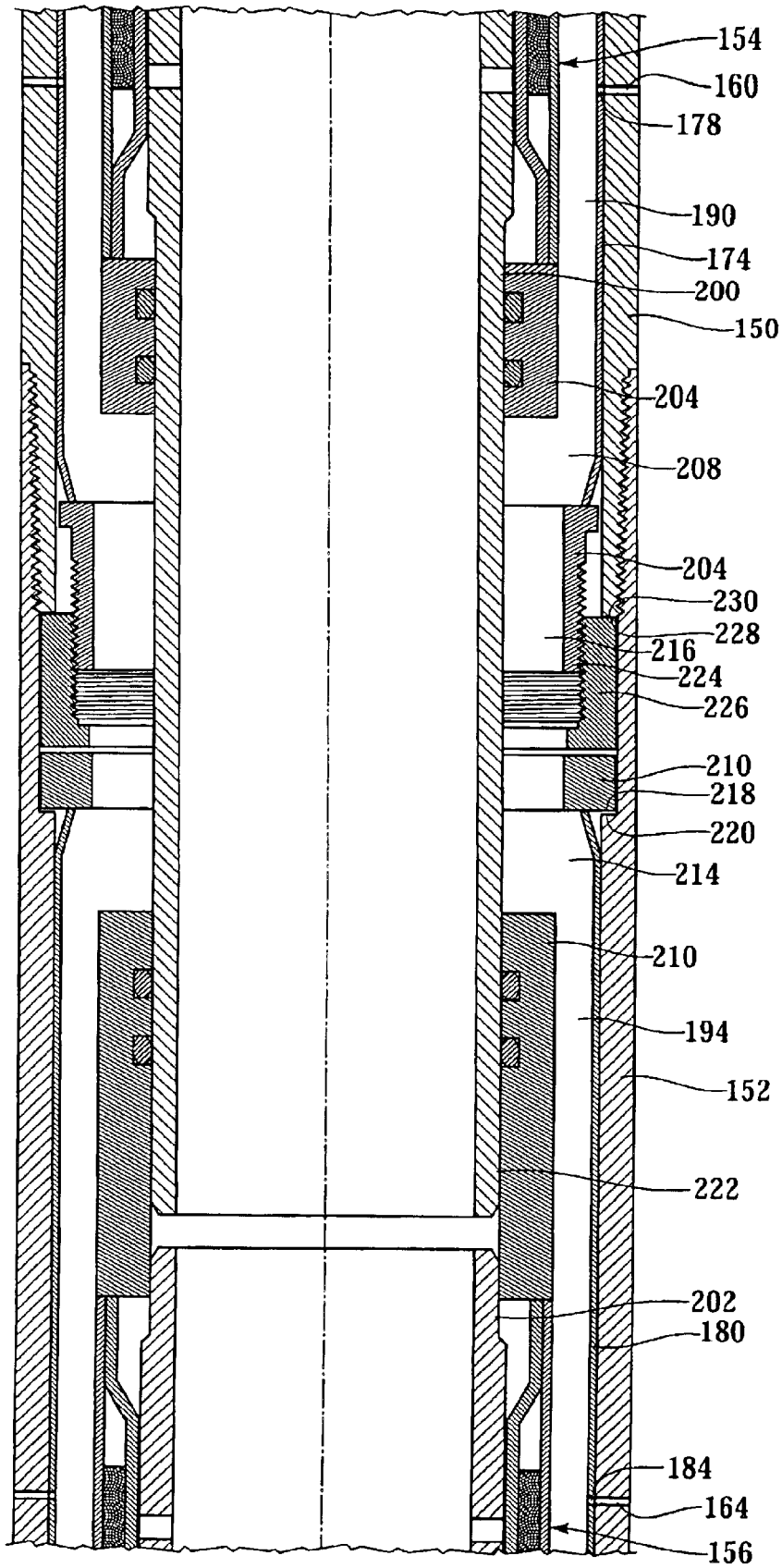
FIG. 8 is a half sectional view of a gravel packing apparatus of the present invention depicting an integrated joint connection.
Figure 9:
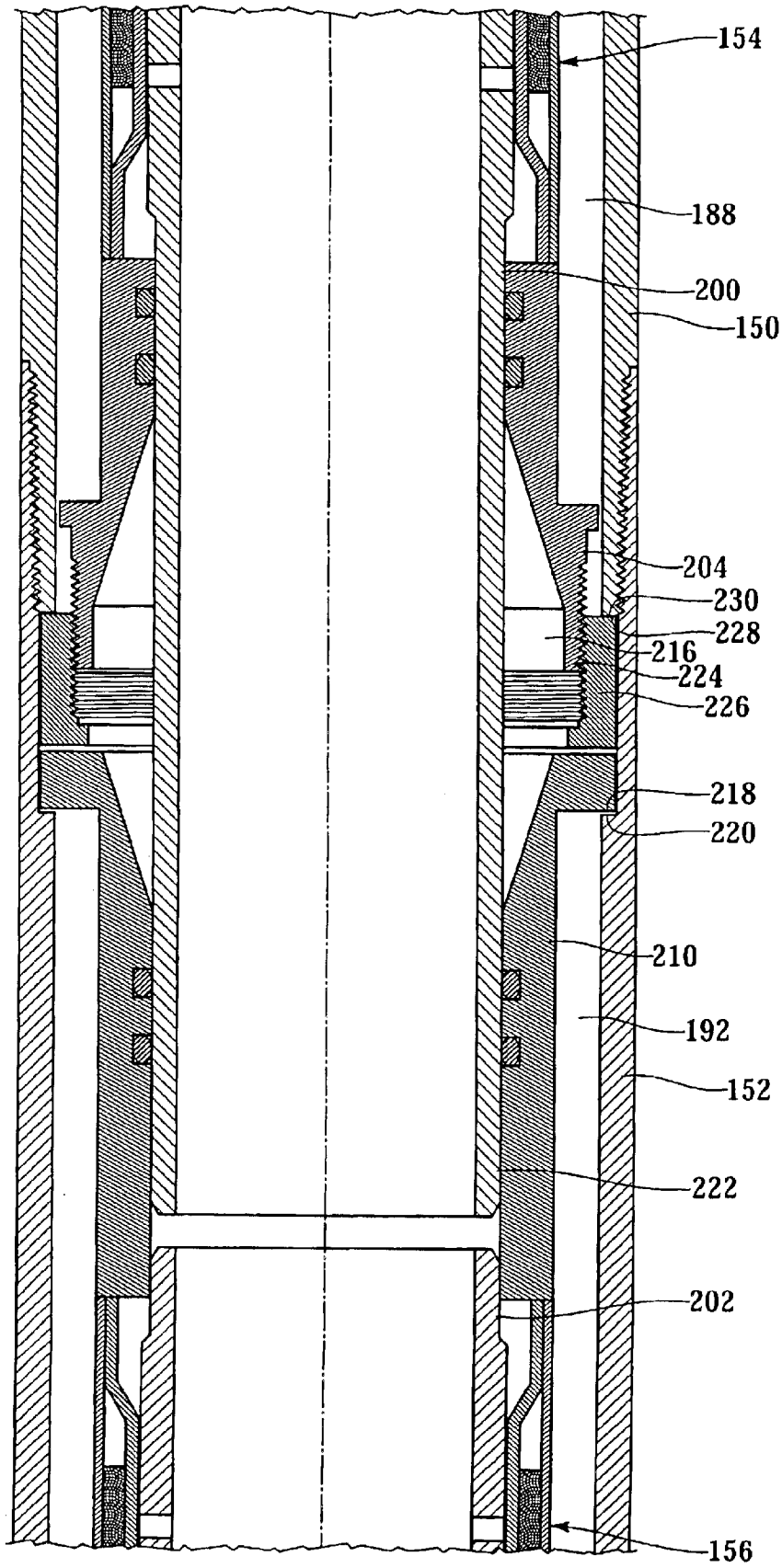
FIG. 9 is a half sectional view of a gravel packing apparatus of the present invention taken at a ninety-degree interval relative to FIG. 8 depicting an integrated joint connection.

Importantly, slurry passageways 190 and slurry passageways 194 are all in fluid communication with one another such that a fluid slurry may travel in and between these passageways from one joint of the gravel packing apparatus of the present invention to the next. Specifically, as best seen in FIGS. 8 and 9, adjoining joints of the gravel packing apparatus of the present invention are depicted with adjacent channels being in circumferential alignment, for clarity of description, and wherein FIG. 8 depicts a cross section that includes the channels and FIG. 9 depicts a cross section that does not includes the channels, for example, at a ninety-degree interval from FIG. 8.

As illustrated, an upper joint of the gravel packing apparatus of the present invention includes outer tubular 150 and sand control screen 154 that is positioned within outer tubular 150 and around base pipe 200. Channels 174 are attached to sand control screen 154 and are depicted in their expanded configuration contacting the interior of outer tubular 150 with outlets 178 being aligned with outlets 160. Likewise, a lower joint of the gravel packing apparatus of the present invention includes outer tubular 152 and sand control screen 156 that is positioned within outer tubular 152 and around base pipe 202. Channels 180 are attached to sand control screen 156 and are depicted in their expanded configuration contacting the interior of outer tubular 152 with outlets 184 being aligned with outlets 164.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that while the gravel packing apparatus of the present invention will likely have the described vertical orientation when assembled on the rig floor, once downhole, the gravel packing apparatus of the present invention is not limited to such orientation as it is equally-well suited for use in inclined and horizontal orientations.

Also, as should be apparent to those skilled in the art, the gravel packing apparatus of the present invention may have a variety of configurations including configurations having other numbers of slurry passageways such as one, three, four or more slurry passageways, such configurations being considered within the scope of the present invention.

Figure 10:
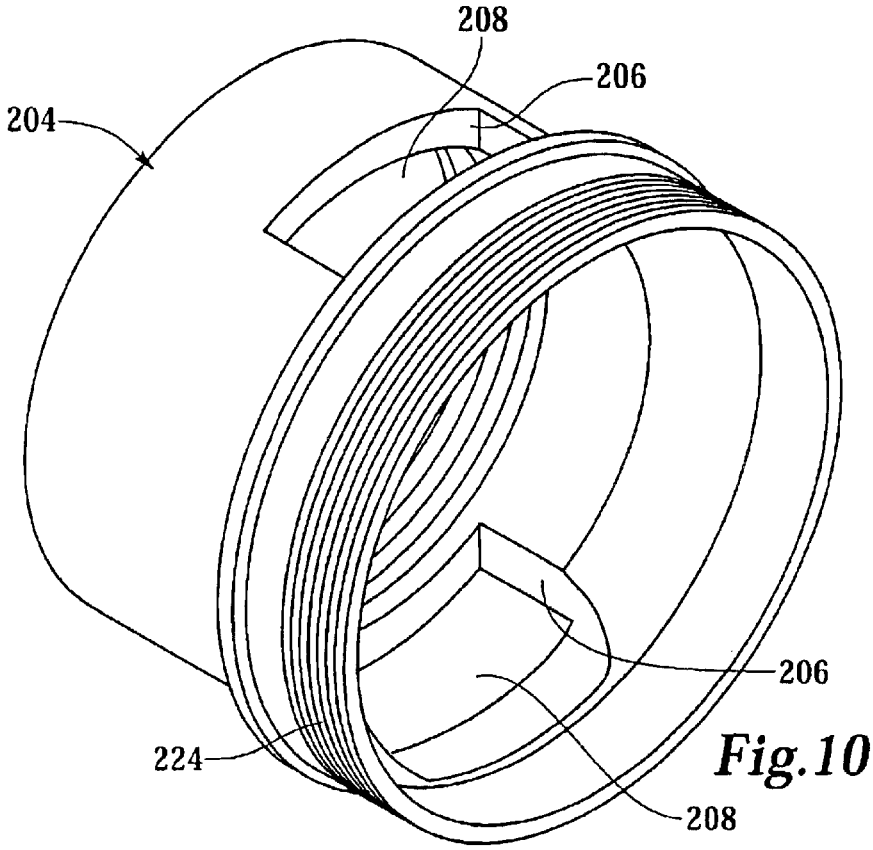
FIG. 10 is an isometric view of a transition member for use in a gravel packing apparatus of the present invention.

Still referring to FIGS. 8 and 9, the integrated joint connection of the gravel packing apparatus of the present invention will now be described. As illustrated, the upper joint includes a transition member 204 that is securably attached to sand control screen 154 and channels 174 by welding or other suitable technique and is in sealing engagement with base pipe 202. Transition member 204 includes cylindrically body portion having a pair of oppositely disposed slots 206 therethrough, as best seen in FIG. 10, that define transition passageways 208. Transition passageways 208 provide a radial path for the fluid slurry in slurry passageways 190 to travel from the exterior to the interior of transition member 204.

Figure 11:
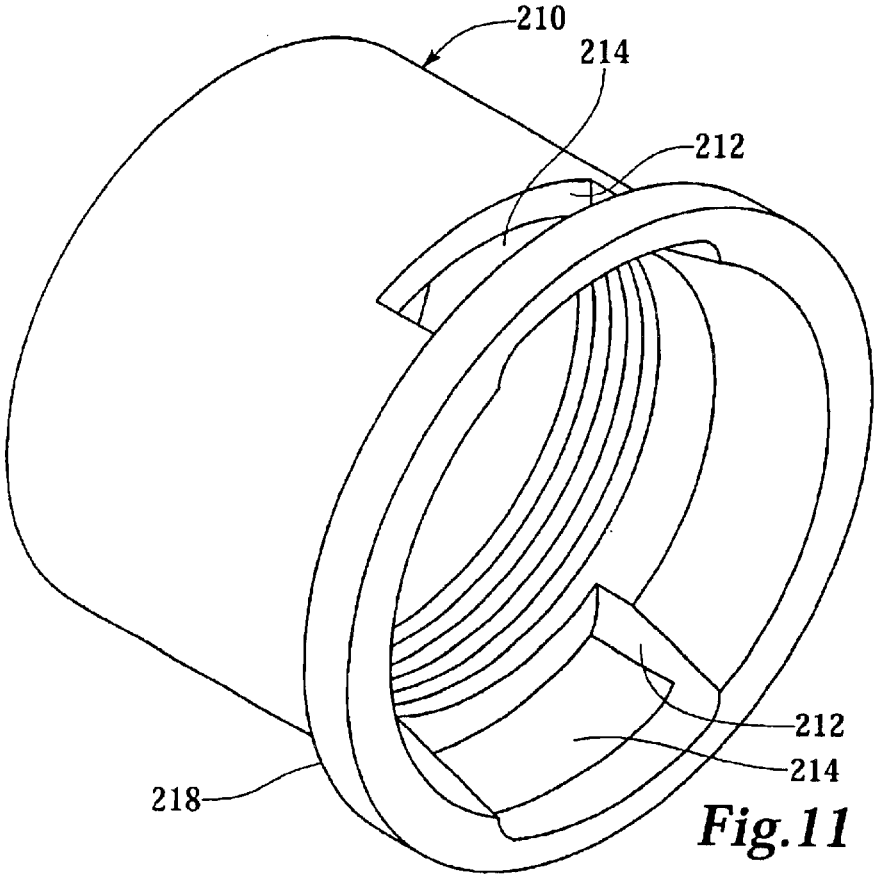
FIG. 11 is an isometric view of a transition member for use in a gravel packing apparatus of the present invention.

Likewise, as illustrated, the lower joint includes a transition member 210 that is securably attached to sand control screen 156 and channels 180 by welding or other suitable technique and is in sealing engagement with base pipe 202 once the upper and lower joints are coupled together. Transition member 210 includes a cylindrical body portion having a pair of oppositely disposed slots 212 therethrough, as best seen in FIG. 11, that define transition passageways 214. Transition passageways 214 provide a radial path for the fluid slurry from the upper joint to travel from the interior to the exterior of transition member 210 and into slurry passageways 194.

In the illustrated embodiment, an annular transition region 216 is created between slurry passageways 190 of the upper joint and slurry passageways 194 of the lower joint in the interior of transition member 204 and transition member 210. Importantly, the length of annular transition region 216 is relatively short and the cross sectional area of annular transition region 216 is controlled by the inner diameter of transition member 204 and transition member 210 between slots 206 and slots 212, respectively, such that the velocity of the fluid slurry traveling through annular transition region 216 can be maintained above the settling velocity of the fluid slurry.

Each joint of the gravel packing apparatus of the present invention is assembled such that the only connection required on the rig floor is the threading of outer tubular 150 to outer tubular 152. More specifically and with reference to the upper joint described in FIGS. 8 and 9, each joint of the gravel packing apparatus of the present invention is assembled by positioning sand control screen 154 around base pipe 200 and in some embodiments, securably attaching sand control screen 154 to base pipe 200. A transition member is then attached at each end of sand control screen assembly 154. At the lower end is a transition member 204. At the upper end is a transition member 210 which extends beyond the upper end of base pipe 200. Channels 174 are then securably attached to sheet members 176 and to sand control screen 154. In addition, channels 174 are securably attached to transition member 204 and transition member 210 such that a fluid communication path is established from the interior of transition member 210 radially through transition passageways 214 into channels 174 and from channels 174 radially through transition passageways 208 into the interior of transition member 204.

Once this inner assembly of the gravel packing apparatus is assembled, outer tubular 150 is positioned therearound. Specifically, the inner assembly is inserted into the box end of outer tubular 150 until an annular shoulder 218 of transition member 210 contacts an annular shoulder 220 within the box end of outer tubular 150. At this point, an end portion 222 of base pipe 200 extends outwardly from the pin end of outer tubular 150. Likewise, an end portion 224 of transition member 204 extends outwardly from the pin end of outer tubular 150. A lock ring 226 is then threadably secured to end portion 224 of transition member 204 until an annular shoulder 228 of lock ring 226 contacts and an annular shoulder 230 of the pin end of outer tubular 150. Once lock ring 226 is in place, the inner assembly is secured within outer tubular 150. As explained above, once in this configuration, channels 174 are pressurized such that channels 174 expand into contact with the interior of outer tubular 150. Thereafter, outlets 178 of channels 174 and outlets 160 of outer tubular 150 may be drilling.

The assembly of the gravel packing apparatus of the present invention is completed on the rig floor. Specifically and with reference to FIGS. 8 and 9, each substantially similar joint is sequentially attached to the next by stabbing a downwardly facing pin end of an upper joint into an upwardly facing box end of a lower joint. The end portion 222 of base pipe 200 that extends outwardly from the pin end of outer tubular 150 is stabbed into the portion of transition member 210 which extends beyond the upper end of base pipe 202. The pin end of outer tubular 150 is then stabbed into the box end of outer tubular 152. Thereafter, the upper joint is rotated relatively to the lower joint to threadably secure the two joins together. Accordingly, this operation is substantially similar to mating typical joints of pipe to form a pipe string requiring no special coupling tools or techniques. Importantly, once mated together, the two joints have formed therebetween the integrated joint connection of the present invention that allows the fluid slurry to be transported through the entire length of the gravel packing apparatus through the various joints.

Figure 12:
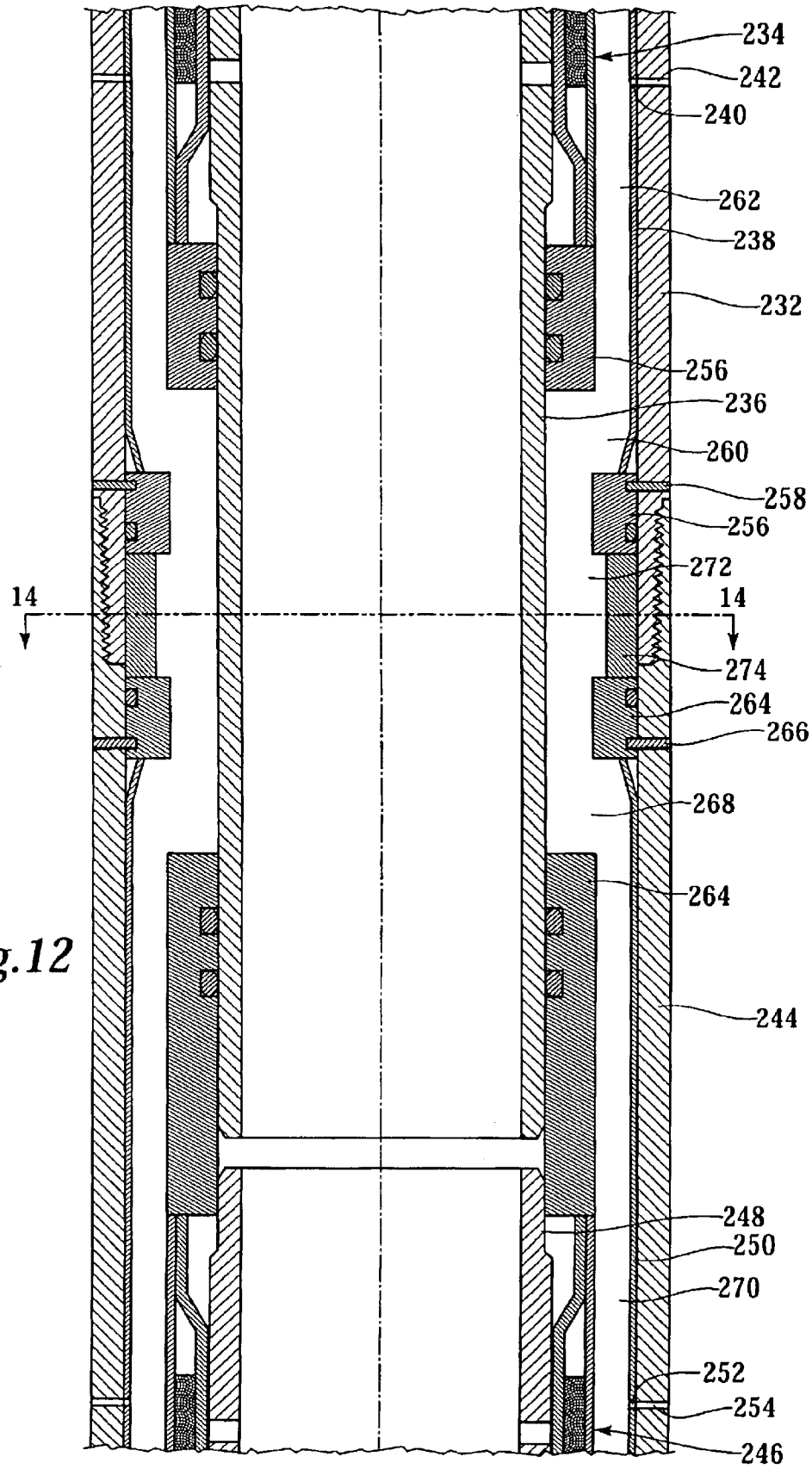
FIG. 12 is a half sectional view of a gravel packing apparatus of the present invention depicting an integrated joint connection.
Figure 13:
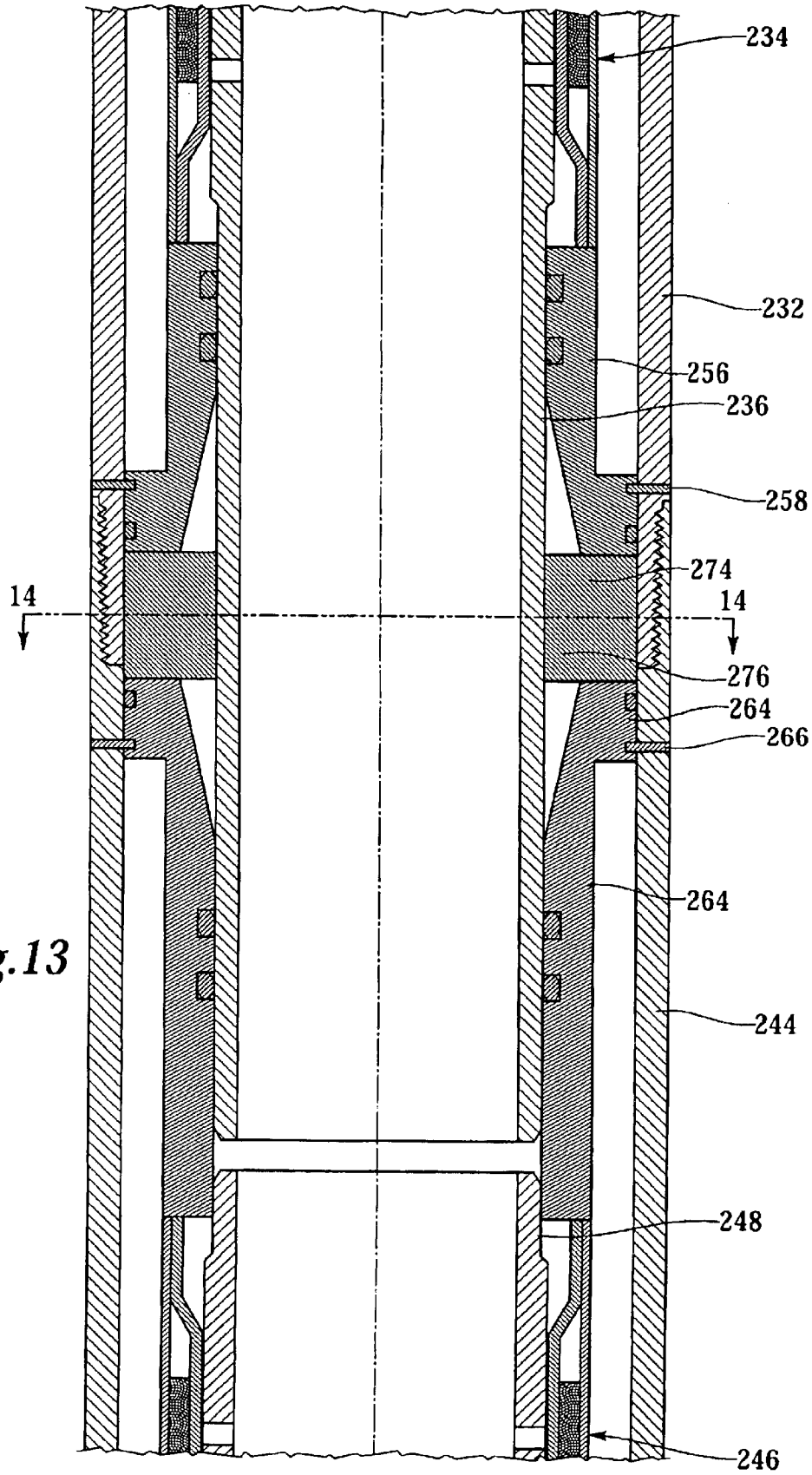
FIG. 13 is a half sectional view of a gravel packing apparatus of the present invention taken at a ninety-degree interval relative to FIG. 12 depicting an integrated joint connection.

Referring next to FIGS. 12 and 13, another embodiment of a gravel packing apparatus of the present invention is depicted. As illustrated, an upper joint of the gravel packing apparatus of the present invention includes outer tubular 232 and sand control screen 234 that is positioned within outer tubular 232 and around base pipe 236. Channels 238 are attached to sand control screen 234 and are depicted in their expanded configuration contacting the interior of outer tubular 232 with outlets 240 being aligned with outlets 242. Likewise, a lower joint of the gravel packing apparatus of the present invention includes outer tubular 244 and sand control screen 246 that is positioned within outer tubular 244 and around base pipe 248. Channels 250 are attached to sand control screen 246 and are depicted in their expanded configuration contacting the interior of outer tubular 244 with outlets 252 being aligned with outlets 254.

As illustrated, the upper joint includes a transition member 256 that is securably attached to sand control screen 234 and channels 238 by welding or other suitable technique, and is in sealing engagement with base pipe 236. In addition, transition member 256 is sealing and securably attached to outer tubular 232 by suitable mechanical means such as pin 258. Transition member 256 includes a pair of oppositely disposed slots that define transition passageways 260. Transition passageways 260 provide paths for the fluid slurry in slurry passageways 262 to travel from the exterior to the interior of transition member 256.

Likewise, as illustrated, the lower joint includes a transition member 264 that is securably attached to sand control screen 246 and channels 250 by welding or other suitable technique and is in sealing engagement with base pipe 236 once the upper and lower joints are coupled together. In addition, transition member 264 is sealing and securably attached to outer tubular 244 by suitable mechanical means such as pin 266. Transition member 264 includes a pair of oppositely disposed slots that define transition passageways 268. Transition passageways 268 provide paths for the fluid slurry from the upper joint to travel from the interior to the exterior of transition member 264 and into slurry passageways 270.

Figure 14:
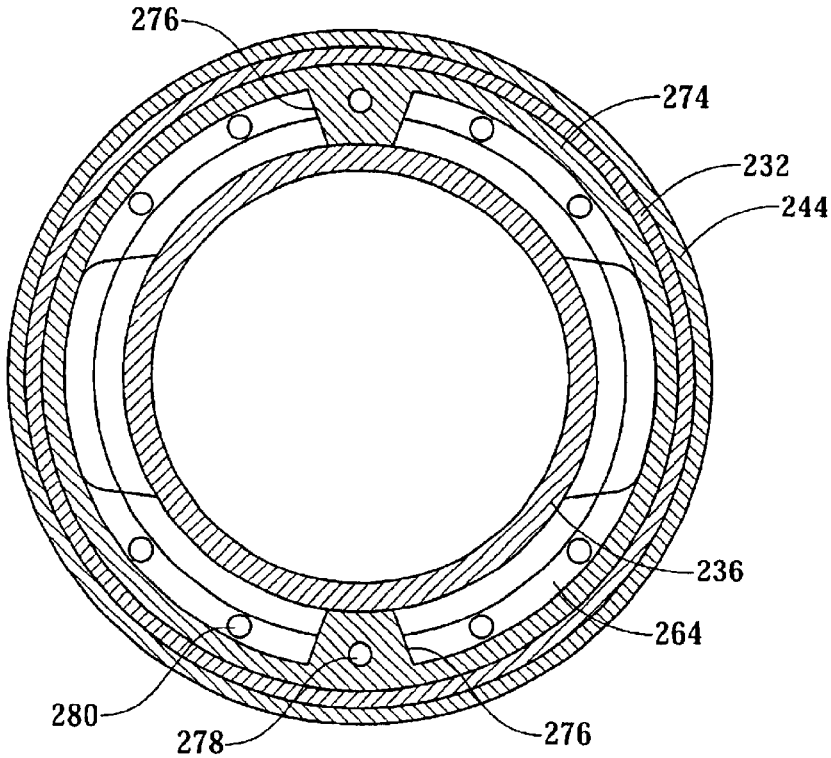
FIG. 14 is a cross sectional view of a gravel packing apparatus of the present invention taken along line 14—14 of FIGS. 12 and 13.

In the illustrated embodiment, a segregated transition region 272 is created between slurry passageways 262 of the upper joint and slurry passageways 270 of the lower joint by seal member 274, as best seen in FIGS. 13 and 14. Seal member 274 includes a pair of boss 276 that sealingly engage base pipe 236 once the upper and lower joints are coupled together. Seal member 274 prevents the mixing of flows from slurry passageways 262 and instead routes the fluid slurry flow from one of the slurry passageway 262 to one of the slurry passageway 270. This segregation of the flows may be desirable in some instances, for example, if the segregated flows of the fluid slurry are selectively delivered to different depths in the annular region around the gravel packing apparatus or if different fluid streams are simultaneous being delivered through the gravel packing apparatus for mixing downhole.

To aid in the creation of segregated transition region 272, timed threads may be used on outer shroud 232 and outer shroud 244 to assure that there is substantial circumferential alignment of slurry passageways 262 of an upper joint relative to slurry passageways 270 of a lower joint. This allows seal member 274 to be oriented circumferentially between slurry passageways 262 and 270, for example at a ninety-degree interval from slurry passageways 262 and 270, creating two independent flow paths through segregated transition region 272.

Figure 15:
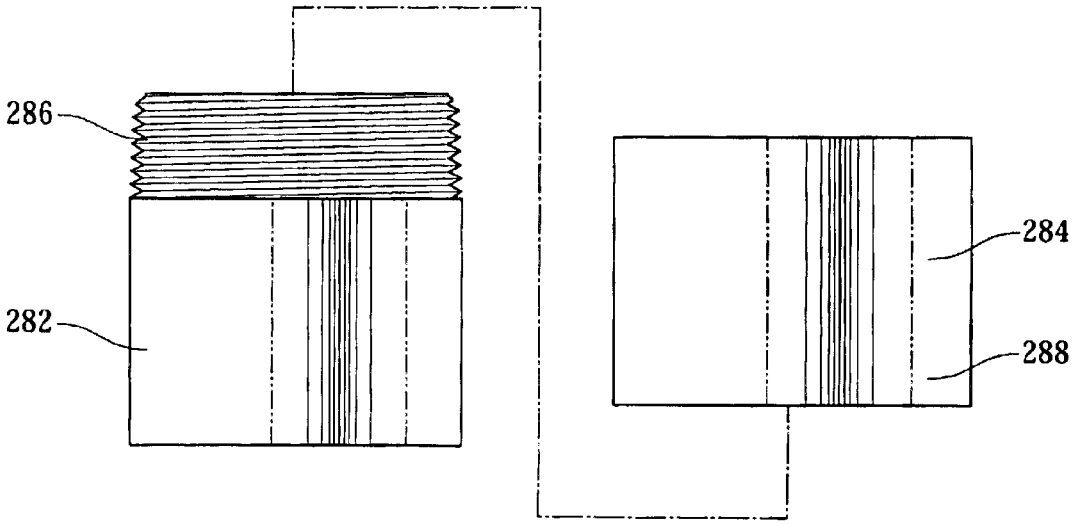
FIG. 15 is a side view of two alignment fixtures of the present invention.
Figure 16:
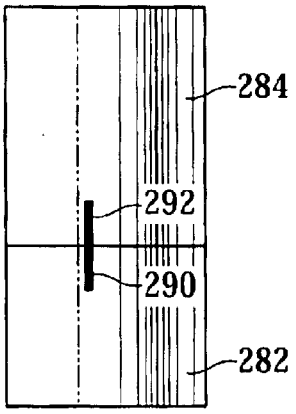
FIG. 16 is a side view of two alignment fixtures of the present invention that are threadably coupled together.

Alternatively, instead of using timed threads, a pair of alignment fixtures 282, 284, as best seen in FIG. 15, may be used to determine the relative circumferential positions of adjacent joints of the gravel packing apparatus of the present invention prior to assembly. Specifically, alignment fixture 282 has a pin end 286 that is inserted into a box end 288 of alignment fixture 284, as best seen in FIG. 16. Once alignment fixtures 282, 284 are properly torqued, a reference index 290 is made on alignment fixture 282 which is preferably in circumferential alignment with a reference index 292 made on alignment fixture 284. It should be noted by one skilled in the art that a single alignment fixture having a threaded box end and a threaded pin end each having an appropriate reference index could alternatively be used without departing from the principle of the present invention.

Figure 17:
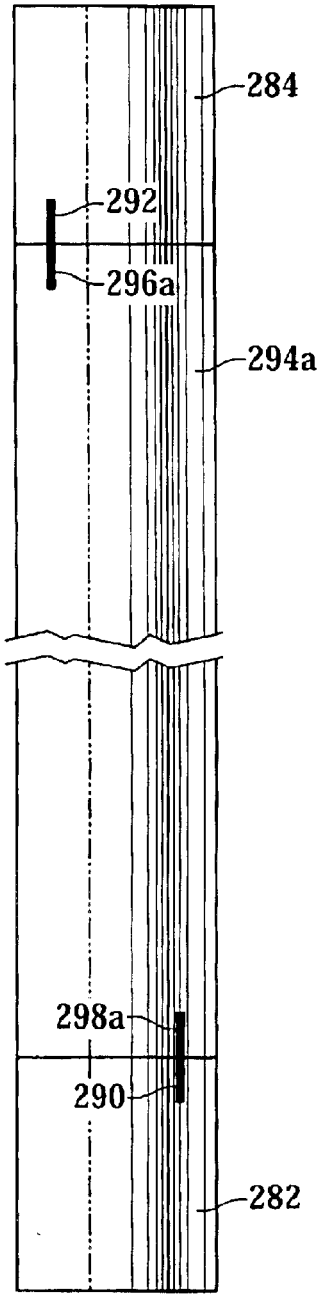
FIG. 17 is a side view of a tubular member having two alignment fixtures of the present invention threadably coupled to respective ends thereof.

Alignment fixture 284, having the known reference index 292 is then threadably coupled to the pin end of each outer shroud, such as outer shroud 294*a*, as best seen in FIG. 17. Once alignment fixture 284 is properly torqued, a reference location, such as reference location 296*a* is made on the pin end of outer shroud 294*a*, preferably aligned at the circumferential location of reference index 292 on alignment fixture 284. Thereafter, alignment fixture 284 is removed from its threaded connection with outer shroud 294*a*. Similarly, alignment fixture 282, having the known reference index 290 is threadably coupled to the box end of each outer shroud, such as outer shroud 294*a*. Once alignment fixture 282 is properly torqued, a reference location, such as reference location 298*a* is made on the box end of outer shroud 294*a*, preferably aligned at the circumferential location of reference index 290 on alignment fixture 282. Thereafter, alignment fixture 282 is removed from its threaded connection with outer shroud 294*a*. As should be understood by those skilled in the art and as illustrated, when timed threads are not used on outer tubular 294*a*, reference locations 296*a* and 298*a* will most likely be at different circumferential positions on outer shroud 294*a*.

Figure 18:
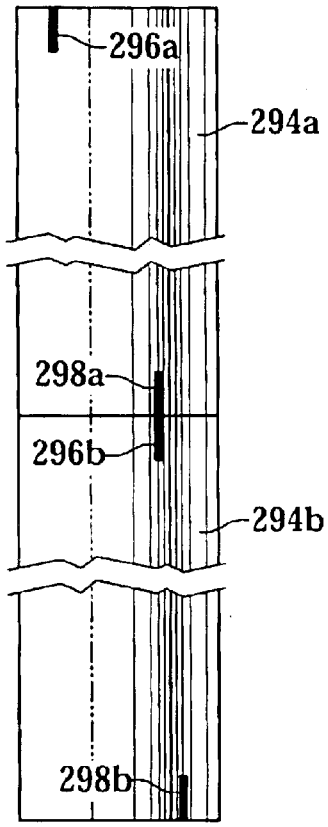
FIG. 18 is a side view of two tubular members having reference location marked thereon such that the relative circumferential alignment of the two tubular members is predetermined according to the present invention.

Once each outer shroud, for example outer shrouds 294*a*, 294*b* of FIG. 18, has been marked with a pin end reference location 296*a*, 296*b* and a box end reference location 298*a*, 298*b*, when outer shrouds 294*a* and 294*b* are threadably coupled together and properly torqued, the box end reference location 298*a* of outer tubular 294*a* will be substantially circumferentially aligned with the pin end reference location 296*b* of outer tubular 294*b*. Accordingly, if the channels are positioned within each outer shroud at a particular circumferential orientation relative to one of the reference locations, for example, circumferentially aligned with the pin end reference location, the relative alignment of the slurry passageways of an upper joint and the slurry passageways of a lower joint can be determined prior to threadably coupling the two joints together.

Based upon this determination, seal member 274 of FIG. 14 can be rotated relative to transition member 264 and fixed in position using mechanical means such as a pin extending through openings 278 in bosses 276 into the appropriate openings 280 in transition member 264. Once seal member 274 is properly rotated and fixed relative to transition member 264 and outer shrouds 232 and 244 are threadably coupled together, as best seen in FIG. 12, the slurry flowing from each slurry passageway 262 of the upper joint will not mix within segregated transition region 272 and will instead independently flow into respective slurry passageways 270 of the lower joint.

Even though FIGS. 12–14 have depicted seal member 274 as including bosses 276 such that flow between adjacent joints of the gravel packing device of the present invention may be segregated, it should be understood by those skilled in the art that a seal member that does not include bosses could alternatively be positioned between adjacent transition members, such as transition members 256, 264 of FIGS. 12 and 13 or transition members 204, 210 of FIGS. 8 and 9, if desired.

Figure 19:
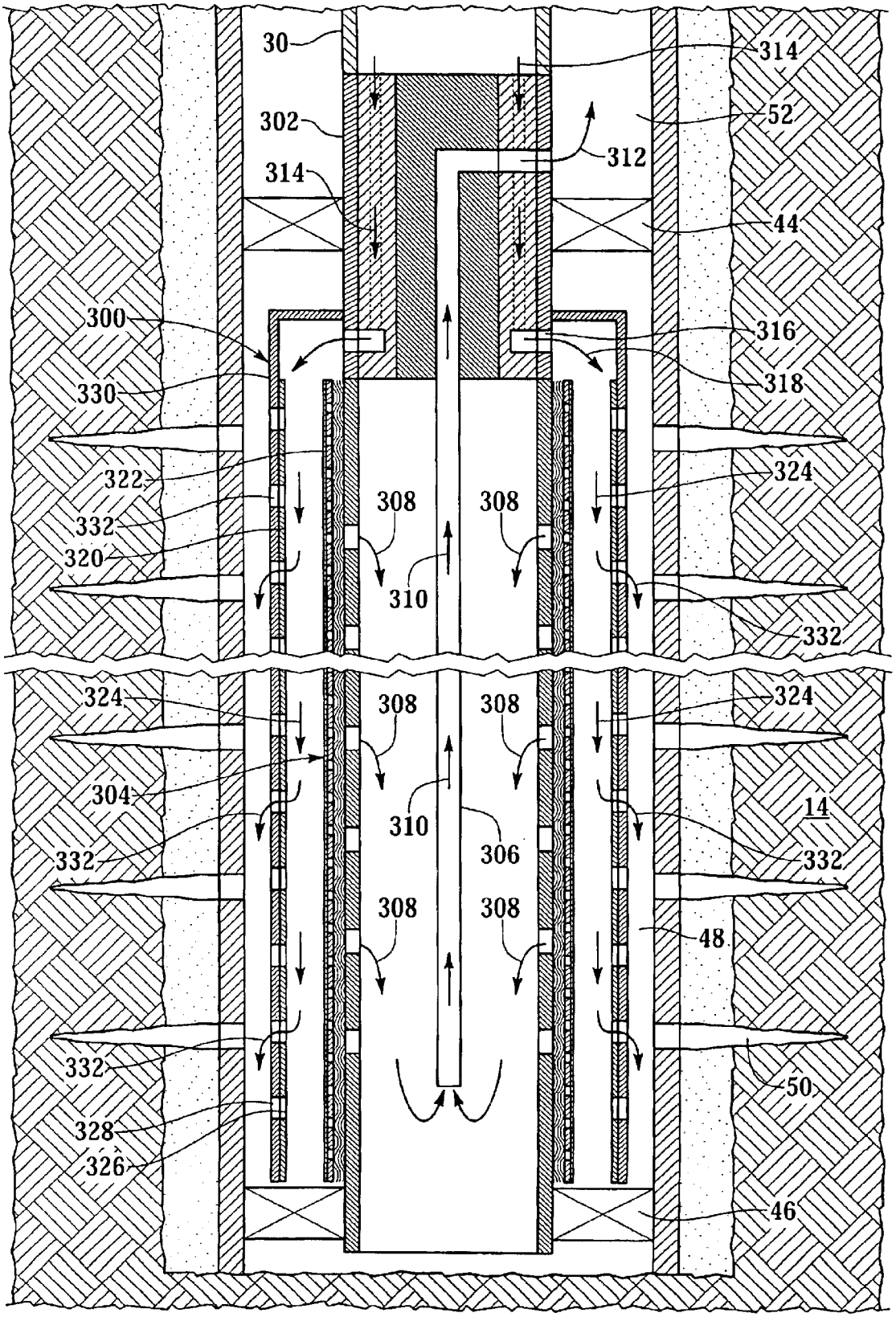
FIG. 19 is a half sectional view depicting the operation of a gravel packing apparatus of the present invention.

Referring now to FIG. 19, a typical completion process using a gravel packing apparatus 300 of the present invention will be described. First, interval 48 adjacent to formation 14 is isolated. Packer 44 seals the upper end of annular interval 48 and packer 46 seals the lower end of annular interval 48. Cross-over assembly 302 is located adjacent to screen assembly 304, traversing packer 44 with portions of cross-over assembly 302 on either side of packer 44. When the gravel packing operation commences, the objective is to uniformly and completely fill interval 48 with gravel. To help achieve this result, wash pipe 306 is disposed within screen assembly 304. Wash pipe 306 extends into cross-over assembly 302 such that return fluid passing through screen assembly 304, indicated by arrows 308, may travel through wash pipe 306, as indicated by arrow 310, and into annulus 52, as indicted by arrow 312, for return to the surface.

The fluid slurry containing gravel is pumped down work string 30 into cross-over assembly 302 along the path indicated by arrows 314. The fluid slurry containing gravel exits cross-over assembly 302 through cross-over ports 316 and is discharged into apparatus 300 as indicated by arrows 318. In the illustrated embodiment, the fluid slurry containing gravel then travels between channels 320 and sheet member 322 as indicated by arrows 324. At this point, portions of the fluid slurry containing gravel exit apparatus 300 through outlets 326 of channels 320 and outlets 328 of outer tubular 330, as indicated by arrows 332. As the fluid slurry containing gravel enters annular interval 48, the gravel drops out of the slurry and builds up from formation 14, filling perforations 50 and annular interval 48 around apparatus 300 forming the gravel pack. Some of the carrier fluid in the slurry may leak off through perforations 50 into formation 14 while the remainder of the carrier fluid passes through screen assembly 304, as indicated by arrows 308, that is sized to prevent gravel from flowing therethrough. The fluid flowing back through screen assembly 304, as explained above, follows the paths indicated by arrows 310, 312 back to the surface.

In operation, the gravel packing apparatus of the present invention is used to distribute the fluid slurry to various locations within the interval to be gravel packed by injecting the fluid slurry into the slurry passageways created by the channels and the sheet members of one or more joints of the apparatus. The fluid slurry exits through the various outlets along the slurry passageway and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlets. This process progresses along the entire length of the apparatus such that the annular area becomes completely packed with the gravel. In addition, a portion of the fluid slurry enters the opening of the outer tubular which provides for the deposit of a portion of the gravel from the fluid slurry in the production pathways between the outer tubulars and the sand control screens. Again, this process progresses along the entire length of the apparatus such that each production pathway becomes completely packed with the gravel. Once both the annulus and the production pathways are completely packed with gravel, the gravel pack operation may cease.

Figure 20:
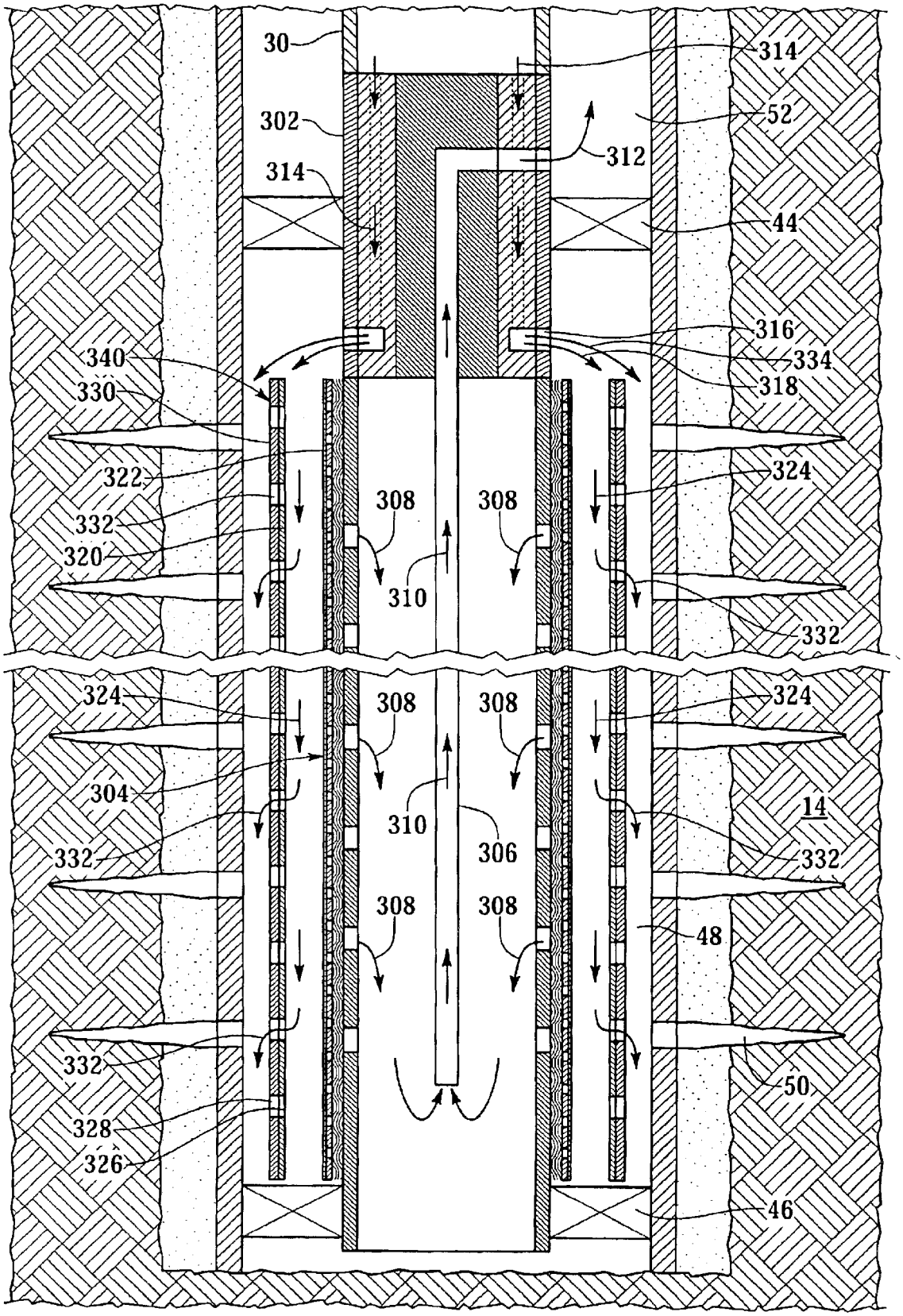
FIG. 20 is a half sectional view depicting the operation of another embodiment of a gravel packing apparatus of the present invention.

In some embodiments of the present invention, the fluid slurry may not initially be injected into the slurry passageways. Instead, the fluid slurry is injected directly into the annulus between the apparatus 340 and the wellbore, as best seen in FIG. 20. In the illustrated embodiment, the primary path for the fluid slurry containing gravel as it is discharged from exit ports 316, is directly into annular interval 48 as indicated by arrows 334. This is the primary path as the fluid slurry seeks the path of least resistance. Under ideal conditions, the fluid slurry travels throughout the entire interval 48 until interval 48 is completely packed with gravel. In addition, the fluid slurry enters the production pathways of apparatus 340 such that this area is also completely packed with gravel.

It has been found, however, that sand bridges commonly form during the gravel packing of an interval when the fluid slurry is pumped directly into annular interval 48. These sand bridges are bypassed using the gravel packing apparatus of the present invention by first allowing the fluid slurry to pass through the outer tubular into the production pathways of apparatus 340, bypassing the sand bridge and then returning to annular interval 48 through the outer tubular to complete the gravel packing process. These pathways are considered the secondary path for the fluid slurry. If a sand bridge forms in the secondary paths prior to completing the gravel packing operation, then the fluid slurry enters channels 320 as indicated by arrows 318 and as described above with reference to FIG. 15. In this embodiment, channels 320 are considered the tertiary path for the fluid slurry.

In either embodiment, once the gravel pack is completed and the well is brought on line, formation fluids that are produced into the gravel packed interval must travel through the gravel pack in the annulus, then enter the production pathways through the openings in the outer tubular where the formation fluids pass through the gravel pack between the outer tubular and the screen assembly. As such, the gravel packing apparatus of the present invention allows for a substantially complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A gravel packing apparatus comprising:

an outer tubular having a plurality of production openings that allow the flow of production fluids therethrough and a plurality of outlets that allow the flow of a fluid slurry containing gravel therethrough, the outer tubular having a first shoulder proximate a first end and a second shoulder proximate a second end;

a sand control screen assembly disposed within the outer tubular, the sand control screen assembly preventing the flow of particulate material of a predetermined size therethrough but allowing the flow of production fluids therethrough;

at least one slurry passageway disposed between the outer tubular and the sand control screen assembly that is in fluid communication with the outlets of the outer tubular;

first and second transition members disposed at opposite ends of the sand control screen assembly and at least partially within the outer tubular, the first transition member contacting the first shoulder; and a lock ring securably attachable to the second transition member and contacting the second shoulder.

2. The apparatus as recited in claim 1 wherein the first transition member includes a slot that is substantially aligned with the slurry passageway allowing fluid to flow between an exterior and an interior of the first transition member.

3. The apparatus as recited in claim 1 wherein the second transition member includes a slot that is substantially aligned with the slurry passageway allowing fluid to flow between an exterior and an interior of the second transition member.

4. The apparatus as recited in claim 1 wherein the first and second transition members are securably attached to opposite ends of the sand control screen assembly.

5. The apparatus as recited in claim 1 wherein the slurry passageway is formed within a channel and the first and second transition members are securably attached to opposite ends of the channel.

6. The apparatus as recited in claim 5 further comprising a production pathway formed within a portion of the outer tubular exterior of the channel.

7. A gravel packing apparatus comprising:

first and second joints each having substantially the same construction and each having a perforated outer tubular, a sand control screen assembly disposed within the outer tubular, at least one slurry passageway and at least one production pathway between the outer tubular and the sand control screen assembly, and first and second transition members disposed at opposite ends of each joint; and a connection between a second end of the first joint and a first end of the second joint such that the second transition member of the first joint is proximate the first transition member of the second joint whereby a fluid traveling from the slurry passageway of the first joint to the slurry passageway of the second joint travels from an exterior to an interior of the second transition member of the first joint and from an interior to an exterior of the first transition member of the second joint.

8. The apparatus as recited in claim 7 wherein the outer tubular of each joint has a first shoulder proximate a first, end and a second shoulder proximate a second end.

9. The apparatus as recited in claim 8 wherein the first transition member of each joint contacts the first shoulder of the outer tubular of each joint.

10. The apparatus as recited in claim 9 wherein each joint further comprises a lock ring securably attachable to the second transition member of each joint and wherein the lock ring contacts the second shoulder of the outer tubular of each joint.

11. The apparatus as recited in claim 7 wherein the first transition member of each joint is securably attachable proximate a first end of the outer tubular of each joint.

12. The apparatus as recited in claim 11 wherein the second transition member of each joint is securably attachable proximate a second end of the outer tubular of each joint.

13. The apparatus as recited in claim 7 wherein the first transition member of each joint includes a slot that is substantially aligned with the slurry passageway of each joint allowing fluid to flow between an exterior and an interior of the first transition member.

14. The apparatus as recited in claim 7 wherein the second transition member of each joint includes a slot that is substantially aligned with the slurry passageway of each joint allowing fluid to flow between an exterior and an interior of the second transition member.

15. The apparatus as recited in claim 7 wherein the first and second transition members of each joint are securably attached to opposite ends of the sand control screen assembly of each joint.

16. The apparatus as recited in claim 7 wherein the slurry passageway of each joint is formed within a channel and the first and second transition members of each joint are securably attached to opposite ends of the channel.

17. The apparatus as recited in claim 16 wherein the production pathway of each joint is formed within a portion of the outer tubular exterior of the channel.

18. The apparatus as recited in claim 7 further comprising a seal member positioned within the connection between the second transition member of the first joint and the first transition member of the second joint.

19. A method for gravel packing an interval of a wellbore, the method comprising the steps of:

providing a gravel packing apparatus having a plurality of joints each including an outer tubular positioned around a sand control screen assembly forming a screen annulus therebetween including an axially extending slurry passageway, and first and second transition members disposed at opposite ends of each joint;

connecting first and second joints such that the second transition member of the first joint is proximate the first transition member of the second joint;

locating the gravel packing apparatus within the interval of the wellbore forming a wellbore annulus; and injecting a fluid slurry into the slurry passageway of the first joint such that a first portion of the fluid slurry exits the slurry passageway into the wellbore annulus and such that a second portion of the fluid slurry travels from the slurry passageway of the first joint to the slurry passageway of the second joint by traveling from an exterior to an interior of the second transition member of the first joint then from an interior to an exterior of the first transition member of the second joint.

20. The method as recited in claim 19 further comprising the steps of:

contacting the first transition member of each joint to a shoulder proximate a first end of each outer tubular;

securably attaching a lock ring to the second transition member of each joint; and contacting the lock ring of each joint to a shoulder proximate a second end of each outer tubular.

21. The method as recited in claim 19 further comprising the step of securably attaching the first transition member of each joint proximate a first end of the outer tubular of each joint.

22. The method as recited in claim 21 further comprising the step of securably attaching the second transition member of each joint proximate a second end of the outer tubular of each joint.

23. The method as recited in claim 19 wherein the fluid flowing from the interior to the exterior of the first transition member of each joint travels through a slot in each first transition member that is substantially aligned with the slurry passageway of each joint.

24. The method as recited in claim 19 wherein the fluid flowing from the exterior to the interior of the second transition member of each joint travels through a slot in each second transition member that is substantially aligned with the slurry passageway of each joint.

25. The method as recited in claim 19 further comprising the step of securably attaching the first and second transition members of each joint to opposite ends of the sand control screen assembly of each joint.

26. The method as recited in claim 19 further comprising the steps of forming the slurry passageway of each joint within a channel and securably attaching the first and second transition members of each joint to opposite ends of the channel.

27. The method as recited in claim 19 further comprising producing fluids through an axially extending production pathway in the screen annulus of each joint.

28. A method for gravel packing an interval of a wellbore, the method comprising the steps of:

providing a first joint having a first perforated outer tubular, a first sand control screen assembly disposed within the first outer tubular, at least one first slurry passageway and at least one first production pathway between the first outer tubular and the first sand control screen assembly, and a transition member disposed at a first end of the first joint;

providing a second joint having a second perforated outer tubular, a second sand control screen assembly disposed within the second outer tubular, at least one second slurry passageway and at least one second production pathway between the second outer tubular and the second sand control screen assembly;

connecting the second joint to the first end of the first joint;

locating the first and second joints within the interval of the wellbore forming a wellbore annulus; and injecting a fluid slurry into the first slurry passageway such that a first portion of the fluid slurry exits the first slurry passageway into the wellbore annulus and such that a second portion of the fluid slurry travels from the first slurry passageway to the second slurry passageway by traveling from an exterior to an interior of the transition member.

29. The method as recited in claim 28 further comprising the step of securably attaching the transition member proximate the first end of the first outer tubular.

30. The method as recited in claim 28 wherein the fluid flowing from the exterior to the interior of the transition member travels through a slot in the transition member that is substantially aligned with the first slurry passageway.

31. The method as recited in claim 28 further comprising the step of securably attaching the transition member to the first sand control screen assembly.

32. The method as recited in claim 28 further comprising the steps of forming the first slurry passageway within a channel and securably attaching the transition member to the channel.

33. A method for gravel packing an interval of a wellbore, the method comprising the steps of:

providing a first joint having a first perforated outer tubular, a first sand control screen assembly disposed within the first outer tubular, at least one first slurry passageway and at least one first production pathway between the first outer tubular and the first sand control screen assembly;

providing a second joint having a second perforated outer tubular, a second sand control screen assembly disposed within the second outer tubular, at least one second slurry passageway and at least one second production pathway between the second outer tubular and the second sand control screen assembly, and a transition member disposed at a first end of the second joint;

connecting the first end of the second joint to the first joint;

locating the first and second joints within the interval of the wellbore forming a wellbore annulus; and injecting a fluid slurry into the first slurry passageway such that a first portion of the fluid slurry exits the first slurry passageway into the wellbore annulus and such that a second portion of the fluid slurry travels from the first slurry passageway to the second slurry passageway by traveling from an interior to an exterior of the transition member.

34. The method as recited in claim 33 further comprising the step of securably attaching the transition member proximate the first end of the second outer tubular.

35. The method as recited in claim 33 wherein the fluid flowing from the interior to the exterior of the transition member travels through a slot in the transition member that is substantially aligned with the second slurry passageway.

36. The method as recited in claim 33 further comprising the step of securably attaching the transition member to the second sand control screen assembly.

37. The method as recited in claim 33 further comprising the steps of forming the second slurry passageway within a channel and securably attaching the transition member to the channel.

* * * * *